United States Patent [19]

Wenzel

[11] Patent Number: 4,716,829

[45] Date of Patent: Jan. 5, 1988

[54] METHOD FOR REMOVING SOLIDS FROM SUBSTRATES AND PREVENTING SOLIDS BUILD-UP THEREON

[75] Inventor: Ronald E. Wenzel, Appleton, Wis.

[73] Assignee: American Can Company, Greenwich, Conn.

[21] Appl. No.: 4,799

[22] Filed: Jan. 5, 1987

Related U.S. Application Data

[63] Continuation of Ser. No. 700,279, Feb. 11, 1985, abandoned.

[51] Int. Cl.[4] ..... B05D 3/12

[52] U.S. Cl. ..... 101/426; 101/425; 134/1; 427/57

[58] Field of Search ..... 101/423–426, 101/350, 366, DIG. 8; 134/1, 34; 118/57, 612, 22, 104, 170, 244; 427/57; 15/94

[56] References Cited

U.S. PATENT DOCUMENTS

| | | | |
|---|---|---|---|
| 2,226,515 | 12/1940 | Presby | 101/DIG. 8 |
| 2,944,484 | 7/1960 | Bruce | 101/425 |
| 3,025,793 | 3/1962 | Vischulis | 134/1 |
| 3,105,779 | 10/1963 | Bulat et al. | 134/1 |
| 3,592,136 | 7/1971 | Selman | 101/423 X |
| 3,698,408 | 10/1972 | Jacke | 134/1 X |
| 4,344,362 | 8/1982 | Ishii | 101/423 |
| 4,497,250 | 2/1985 | Dressler | 101/425 X |
| 4,507,155 | 3/1985 | Cheek | 101/424 X |
| 4,517,267 | 5/1985 | Berger et al. | 134/1 X |
| 4,526,102 | 7/1985 | Grobman | 101/425 |

FOREIGN PATENT DOCUMENTS

| | | | |
|---|---|---|---|
| 154797 | 12/1980 | Japan | 29/846 |
| 52652 | 3/1984 | Japan | 101/425 |
| 719239 | 12/1954 | United Kingdom | 101/356 |
| 2089289 | 6/1982 | United Kingdom | 101/424 |

OTHER PUBLICATIONS

"The Present State-of-the-Art-in-Sonic Cleaning", Journal of the American Association for Contamination Control, 22–24, Oct. 1, 1965.

"Ultrasonic Cleaning Equipment Currently in use in Japan", Japan Electronic Engineering, pp. 28–34, No. 54, May 1971.

"Improved Cleaning System", Xe Disclosure Journal, vol. 4, No. 1, Jan/Feb. 1979, p. 107.

*Primary Examiner*—Eugene H. Eickholt

*Attorney, Agent, or Firm*—Paul R. Audet; Thomas D. Wilhelm

[57] ABSTRACT

Method and apparatus are disclosed for removing dried solids, and substantially preventing the accumulation of dried solids on equipment which is used to transfer liquids having components therein capable of forming a solid phase at conditions of operation. Liquids transferred include inks, adhesives and varnishes. The removal of solids and prevention of their accumulation is effected by applying ultrasonic energy to the transfer surface through the reservoir of liquid being supplied for transfer. Exemplary processes include printing, coating, and painting.

25 Claims, 12 Drawing Figures

METHOD FOR REMOVING SOLIDS FROM SUBSTRATES AND PREVENTING SOLIDS BUILD-UP THEREON

This application is a continuation of application Ser. No. 700,279, filed Feb. 11, 1985, and now abandoned.

BACKGROUND OF THE INVENTION

In the art of printing, a cylindrical roll is commonly used partially submerged in a reservoir of the liquid being printed. As the roll is rotated in the liquid, it picks up a small amount of liquid which may be transferred, either to a printing surface for printing or coating thereon, or it may be transferred to another component of the printing equipment, such as an offset roll. Rolls used to pick up the liquid from the reservoir commonly have depressions on the surface of the roll. The depressions may have a uniform pattern as for applying a uniform amount of the liquid over the entire surface of the printing surface. For these applications, the depressions may, for example, comprise a series of uniformly spaced grooves of uniform configuration, each groove extending along the length of the cylinder. Variations in the design and orientation of the configuration of depressions provide for non-uniform applications and the application of patterns of material. Typical applications of this technology include applying coatings and adhesives; and printing onto various printing surfaces such as paper, plastics, metal and cloth.

Rolls having design patterns of depressions on the surface find common use in the printing of intricately colored designs and pictures by the rotogravure printing method. Such rolls typically have individual spot depressions thereon generally in the size range of 40 microns depth, 140 microns width. The depressions are commonly made by the etching process, and the rolls are commonly called rotogravure rolls or etched rolls.

Rolls having a uniform pattern of depressions, lines, grooves, etc., and those having a matte or smooth surface find common use in the application of coatings and in offset printing.

The technology of this invention pertains primarily to the use of cylindrical rolls for applying to a printing surface a liquid containing components capable of forming a solid phase at the conditions of operation. More particularly, the invention deals with the tendency of the liquid to form deposits of solid phase material on the rolls. The formation of such deposits is a problem common to several types of liquid application processes. For example, an ink commonly includes, in its composition, a resin, a solvent for the resin, and a colorant such as pigment or dye. Other components may be included to assist in the functioning of these three major components. The purpose of the ink is to form solid deposits, especially of the resin and colorant, on a printing surface. In the basic functioning of a roll-based printing system using ink, a roll is positioned so that a portion of the roll is in a reservoir of the ink. As the roll is rotated about its longitudinal axis, surface portions of the roll are submerged in the ink and then emerge therefrom in concert with the rotation of the roll. A small amount of ink adheres to the surface of the roll and is carried with it out of the reservoir. A printing surface for receiving the ink may be brought against the portion of the roll which is out of the reservoir and having the ink thereon, and some of the ink may be transferred in this manner to the printing surface. For many ink compositions, the solvent acts as a carrier for the resin and colorants. The solvent, being relatively volatile, is typically removed from the ink system after the printing onto the printing surface by evaporation of the solvent, typically with heat in a dryer, leaving the resin and colorant as a dried solid phase printed image. The same evaporation of solvent that is so critical to drying of the ink, and its permanency on the printing surface, presents problems in functioning of printing equipment over an extended period of time. While the ink on the printing equipment is not normally subjected to the drying heat as applied to the printed surface, typical solvents have significant vaporization rates at normal atmospheric operating conditions. While the rate of evaporation at these conditions is slow compared to drying rates on, for example, a heated printing surface, the printing equipment may be exposed to such atmospheric vaporization conditions over extended periods of operation. The combined effect of the extended equipment running time and the significant vaporization rate is significant to thickening and drying of ink on the printing equipment, even though the rate of vaporization is relatively slower. The main problem dealt with here is that vaporization of solvent occurs, albeit at a slower rate, at any interface between the ink and the atmosphere, the amount of vaporization depending, in part, on the surface area of ink which is exposed to the atmosphere, as vaporization occurs from the entire exposed surface area. The degree of significance of this vaporization is dependent, in part, on the ratio of (i) the surface area exposed to the atmosphere and (ii) the quantity of ink involved.

When ink is first picked up from the ink reservoir by a roll, the noraml process of vaporization continues, but over a substantially increased surface area (i.e. the surface of the roll) while involving the same quantity of ink as before the ink was picked up onto the roll. A portion of the ink on the roll may be transferred to a printing surface as a printed image. Another portion of the ink on the roll remains on the roll even after printing of ink onto a printing surface. Thus a certain amount of the ink picked up from the ink reservoir is not deposited on the printing surface, but rather, remains on the roll, with vaporization of solvent, and coagulation of resin or other potentially solid phase material continuing with time, at any given point on the roll until it is again immersed in the ink reservoir by continued rotation of the roll.

In cases where the printing roll is etched, as in rotogravure rolls, excess ink is commonly wiped from the surface of the roll by a doctor blade between exiting of the ink reservoir and being printed on the printing surface. Thus, the ink is primarily concentrated in the individual etched depressions. On contact with the printing surface, a significant portion, for example half, of the ink in a given depression is transferred to the printing surface to form a printed image. The balance of the ink in that depression stays in the depression as the roll continues to rotate and return it into the ink in the ink reservoir.

It is well known that, over a period of use of a rotogravure cylindrical printing roll, a quantity of more or less solid phase material from the ink accumulates in the depressions of the roll surface. As the solid phase material accumulates, occupying a portion of the volume of the depression, the empty volume of the depression, after printing contact with the printing surface, becomes progressively smaller. Similarly, the volume of ink which can be picked up from the reservoir becomes progressively smaller. As the volume of ink picked up from the reservoir and transferred to the printing surface changes, the perceived quality of the printed image decreases, as compared to the desired, or designed, image. Quality of image continues to decrease with time, until finally the operation is stopped, and the solid phase material removed by mechanical action such as by wiping with a cloth, and in some cases, the use of wire brushes, and optionally the use of solvent.

As used herein, the definitions of the expressions "dry", "drying", "dried in ink solids", and "solid phase materials", as they relate to inks and other liquids transferred in the invention, include agglomerations of liquidous materials having a substantially higher fraction of solid-forming material than the liquid as a whole, as well as their normally accepted definitions. For example, an accumulation of ink in a depression of a gravure cylinder may have a substantially lower solvent content than the ink as a whole. This type of accumulation is included in the terms "dry" ink, "dry" liquid, "dried in ink solids" and "solid phase materials" as used herein.

One method of dealing with the problem of ink drying on the roll is to reformulate the ink to reduce the rate of evaporation of the solvent. While the problem of ink drying on the roll is somewhat reduced by this practice, a direct result of the slower solvent vaporization rate is a necessary process adjustment, such as adjustment of either the running speed of the printing press operation or the heat input to the dryer, to provide for adequate drying and curing of the ink on the printed surface.

While the problem of ink drying on the printing roll is thus somewhat positively improved, the exemplary slower operating speeds or higher dryer heat input has a negative impact on, for example, the economics of the process. There remains a need for a means of operating high speed printing press type equipment, where an ink is picked up on a transfer medium and transferred to a printing surface without the ink drying on the transfer medium to the extent it affects the quality of the printed image. Resolution of the problem as it applies to printing inks could also be applied to similar transfers of adhesives, varnishes, paints, and the like.

Thus it is an object of this invention to provide an improved method of applying, to a printing surface, by means of a transfer surface, a liquid containing components capable of drying on the transfer surface, and accomplishing the transfer without attendant drying of the liquid on the transfer surface.

It is a more particular object of the invention to provide a method of printing, using a printing roll, and especially a rotogravure roll, and accomplishing the printing without attendant drying of the ink on the roll.

It is another object to provide a novel method of removing dried-in solids from a transfer surface.

It is a more specific objective to provide a method of removing, from a printing roll, ink dried on its surface or in its surface depressions.

Another object of the invention is to provide a system for applying to a printing surface, by means of a transfer surface, a liquid containing components capable of drying on the transfer surface, and accomplishing the transfer without attendant drying of the liquid on the transfer surface.

A more specific object is to provide an improved system for printing, as for rotogravure printing, and accomplishing the printing without attendant drying of the ink on the rotogravure printing cylinder.

SUMMARY OF THE INVENTION

It has now been found that these and other objectives are achieved in a process for removing a solid phase material from a selected portion of a substrate. The first step in the process is putting the solid phase material and the corresponding selected portion of the substrate into a liquid having a viscosity less than 300 centipoise, the liquid including (i) a solvent for the solid phase material and (ii) a significant initial amount of a contaminant. The contaminant may include material chemically similar to the solid phase material. The secondstep is that of applying to the substrate and the solid phase material, through the contaminated liquid, an effective amount of ultrasonic energy, whereby the solid phase material is removed from the selected portion of the substrate.

During the process, the solid phase material on the selected portion of the substrate may be intermittently removed from the liquid. In that event, the removal is for a period of time insufficient to permit accumulation of an amount of dried contaminant on the substrate which is more than the amount of dried material which is removed on a subsequent dipping into the liquid.

In typical processes of the invention, the substrate is a generally cylindrical roll partially immersed in a reservoir of the liquid. The liquid includes a film-forming resin, and may also further include a colorant such as dye or pigment. The preferred viscosity of the liquid is between 5 centipoise and 40 centipoise.

In a very desirable application, the invention is embodied in a process for removing dried-in ink solids from depressions of an etched printing roll. The first step in the process is putting a portion of the roll in an ink similar or equivalent to the ink which produced the dried in ink solids, and wherein the ink contains a solvent for the dried-in ink solids and has an overall viscosity of less than 300 centipoise. It is not necessary that the roll be entirely submerged in the ink at any time. After it has been dipped in the ink, the roll is rotated, in the ink, about its axis. While the roll is in the ink, an effective amount of ultrasonic energy is applied to the ink in the reservoir, whereby the ultrasonic energy is transferred through the liquid to the roll and the dried-in ink. The dried-in ink solids are removed from the roll at those portions of the roll which are wetted by the ink, by a combination of chemical action of the solvent and mechanical action of cavitation produced by the ultrasonic energy.

In preferred operation of the invention, the entire length of the circumferential surface of the roll is wetted by the ink and the dried-in ink solids are removed from the depressions along the entire length of the roll. Also in preferred operation, the ultrasonic energy has a frequency of between 20 kilohertz and 40 kilohertz.

The invention is also embodied in a method of applying to a printing surface a liquid containing components capable of forming a solid phase at the conditions of operation. The liquid is placed in a liquid reservoir. A portion of a transferring means for transferring liquid from the reservoir to the printing surface is positioned in the liquid. The transferring means may have depressions thereon capable of holding a small quantity of the liquid. A quantity of the liquid is picked up from the reservoir, on the tranferring means. A first portion of the quantity of liquid is deposited from the transferring means onto the printing surface, whereby the second portion of the quantity of the liquid remains on the transferring means. The second portion, on the transferring means, is returned to the liquid reservoir. An effective amount of ultrasonic energy is applied to the liquid in the liquid reservoir, whereby the second portion of the quantity of liquid is effectively prevented from forming an actual solid phase, as compared to a liquidous solid phase, on the transferring means.

In more preferred embodiments, the liquid is a printing ink, the transferring means is a cylindrical printing roll, and the entire length of the circumferential surface of the roll is wetted by the ink. The viscosity of the ink is between 5 centipoise and 40 centipoise and the ultrasonic energy has a frequency of between 20 kilohertz and 40 kilohertz.

In some preferred embodiments, the ink has a viscosity of between 5 centipoise and 30 centipoise and is transferred from the printing roll directly onto a printed surface, as in rotogravure printing.

In other preferred embodiments, the ink has a viscosity of betweeen 25 centipoise and 40 centipoise and is transferred first to an offset roll and from the offset roll onto a printed surface, as in offset flexographic printing.

The invention is further illustrated as a method of printing wherein an etched roll is positioned, and rotated in a reservoir of ink, the method comprising withdrawing ink, from the ink reservoir, in the etchings in the roll and transferring it to a receiving surface, wherein the improvement comprises applying to the ink in the reservoir, an effective amount of ultrasonic energy to prevent the ink from drying in the etchings. The method is functional where the viscosity of the ink is less than 300 centipoise. Preferably the ultrasonic energy has a frequency of between 20 kilohertz and 40 kilohertz.

Another aspect of the invention is in a system for applying, to a surface, a liquid containing components capable of forming a solid phase at conditions of operation. The system includes a liquid reservoir, a contaminated liquid in the reservoir, and a trasferring means for transferring the liquid from the reservoir to the surface. The transferring means is positioned such that a portion of it is in the liquid in the reservoir. The system further includes means for applying ultrasonic energy to the liquid in the reservoir. The transferring means is preferrably a cylindrical roll have etchings thereon suitable for transferring small portions of a liquid having a viscosity of between 1 centipoise and 300 centipoise.

Preferrably the means are applying ultrasonic energy is an ultrasonic transducer whose emitter is positioned in the reservoir and in the liquid, such that ultrasonic energy may be transmitted through the liquid to the roll over a straight line distance of between ⅛ inch and 5 inches.

Desirably the emitter is generally the same length as the roll and is designed to emit a relatively uniform amount of energy along its length.

The invention is readily seen as a system for printing an ink onto a printing surface, where the system is comprised of an ink reservoir, an ink in the reservoir, a roll positioned such that a portion of it is in the ink reservoir, and means for applying ultrasonic energy to the ink in the reservoir. The means for applying ultrasonic energy is readily found in an ultrasonic transducer whose emitter is positioned in the reservoir, in the ink, such that ultrasonic energy may be transmitted through the ink to the roll over a straight line distance of between ⅛ inch and 5 inches.

DETAILED DESCRIPTION OF THE INVENTION

The invention generally applies to the arts of printing and coating, and more particularly to an aspect of printing which uses rolls having patterned surfaces to pick up ink from a reservoir and transfer it to a printing surface for printing thereon, or to transfer ink to an offset roll which is used to subsequently transfer the ink to a printing surface.

Figure 1:
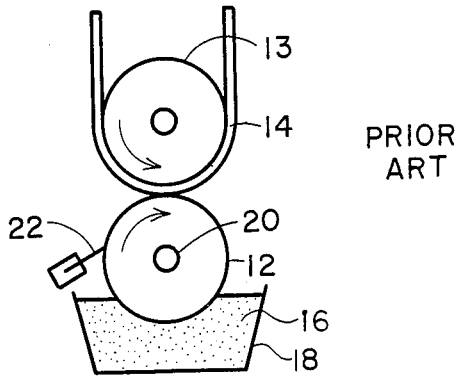
FIG. 1 is an end view of a prior art direct contact printing station, with the end of the ink reservoir removed, and enough ink displaced to show the end of the roll in the reservoir.

FIG. 1 shows a prior art outline of a printing station as is common to the art for direct transfer of ink from a rotogravure roll 12 to a printing surface 14, which is wrapped around roll 13. Ink 16 is picked up by the depressions in etched rotogravure roll 12 from ink in the reservoir 18, as roll 12 rotates about its axis 20 in the direction shown by the arrow. Excess ink is removed from the surface of roll 12 by doctor blade 22 and ink is tranferred from the surface of roll 12 to printing surface 14 at point of contact of roll 12 and printing surface 14.

Figure 2:
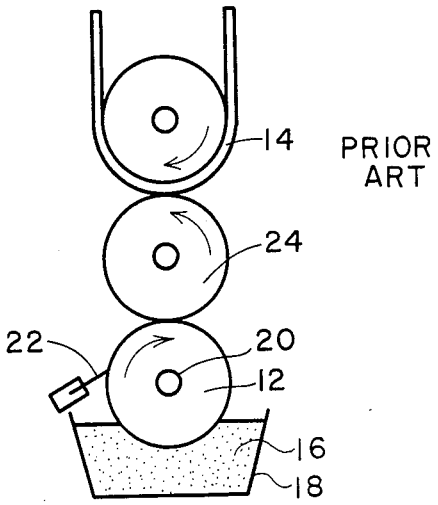
FIG. 2 is an end view of a prior art offset printing station, with the end of the ink reservoir removed, and enough ink displaced to show the end of the roll in the reservoir.

Prior art FIG. 2 shows the same general type of printing operation as in FIG. 1 except that offset roll 24 is imposed between the pick-up roll 12 and printing surface 14. Ink is picked up on roll 12 and the excess removed by doctor blade 22 as in FIG. 1. Ink is transferred to roll 24 at point of contact of rolls 12 and 24. Roll 24 may have a pattern thereon for picking up ink from a portion of the ink-holding surface of roll 12. As roll 24 continues to rotate, the ink is then transferred to printing surface 14 at point of contact of the printing surface 14 and roll 24.

Figure 3:
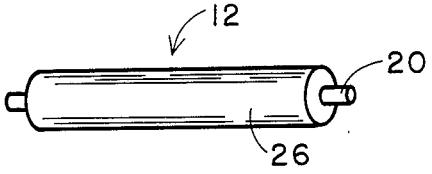
FIG. 3 is a pictorial view of a typical rotogravure roll as it would appear to casual observation.

A typical etched rotogravure roll 12 for use in this invention, and as in the assemblies of FIG. 1, is shown pictorially in FIG. 3 as it would appear to casual observation. The roll, generally designated 12, has a cylindrical surface 26 and centrally located axis of rotation 20.

Figure 4:
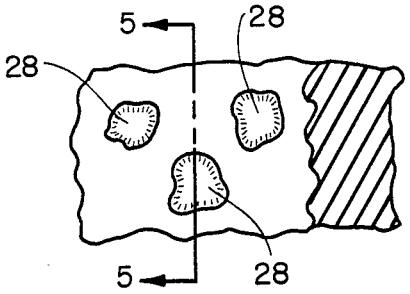
FIG. 4 is a representative portion of the surface of the roll in FIG. 3, greatly enlarged.

FIG. 4 is a representative portion of surface 26 greatly enlarged to show etched spot depressions 28 typical of rotogravure rolls useful in this invention. A typical depression 28 has a width of about 140 microns and a depth of about 40 microns. Substantial variations from these dimensions are normal.

Figure 5:
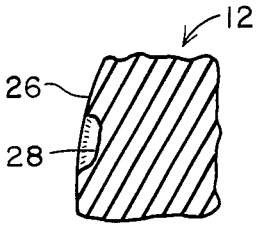
FIG. 5 is a cross-section of a portion of the roll taken at 5—5 of FIG. 4, and showing one depression in cross-section.

FIG. 5 shows a cross-section of FIG. 4 and shows generally the depth of a depression 28 which picks up ink from the ink reservoir.

Figure 6:
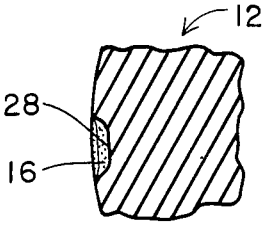
FIG. 6 is a cross-section as in FIG. 5 and showing the depression generally filled with a quantity of ink.

In FIG. 6, the depression 28 is holding a quantity of ink 16 which generally fills the depression.

Figure 7:
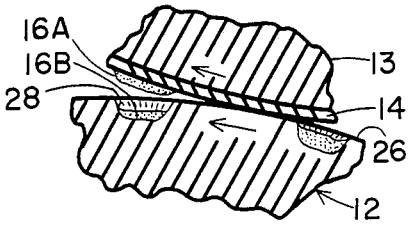
FIG. 7 shows the cross-sectional relationships of various parts shortly after transfer of ink from a depression on a roll to a printing surface, with a portion of the ink remaining in the depression.

In FIG. 7, a depression shown as 28 has just passed point of contact with printing surface 14. As is seen, a first portion 16A of the ink has been transferred to printing surface 14 and a second portion 16B of the ink has been retained in depression 28. The problem being dealt with in the invention regards primarily the second ink portion 16B.

It is desirable that ink portion 16A be easily dried and cured, for permanence of the printed image. It is concurrently desirable that ink portion 16B remain liquid. Problems addressed herein, and associated with prior art printing are due to the drying, or partial drying, of the portion 16B between the time portions 16A and 16B are separated, and thus defined at the point of printing contact as understood from FIG. 7, and the time when portion 16B and depression 28 are reimmersed in the reservoir of ink by continued rotation of roll 12 as in FIGS. 1 and 2.

In the formulation of an ink, the artisan deals with the conflicting needs of having the printed ink portion as at 16A easily dried by evaporation of solvent while the retained ink portion 16B should not dry in depression 28, lest the depression be partially filled with dried-in ink, and thus the printing characteristics of depression 28 be changed. With the primary purpose of the operation being that the ink be printed and consolidated on the printing surface, ink is formulated primarily toward that objective. Consequently, many inks used in printing such as illustrated in FIGS. 1 and 2 or FIGS. 8–11 use solvents having high rates of vaporization. Typical solvents are ethanol, normal propyl acetate and toluene. Since the same vaporization as affects the printed image portion 16A of the ink also affects the portion 16B of ink left in depression 28, a certain amount of vaporization does occur from the surface of portion 16B, such that portion 16B contains a reduced amount of solvent and, thus, tends to be thicker, or more viscous by the time it is resubmerged in the reservoir of ink.

The amount of vaporization that occurs from the portions 16B can also be affected somewhat by the general environment of the operation. Vaporization rate of the solvent is especially influenced by atmospheric temperature and relative humidity, as is the vaporization rate of any liquid. Higher temperature effects higher vaporization rate than does lower temperature. Lower relative humidity effects higher vaporization rate than does higher relative humidity. The general environment of the operation is those ambient conditions that exist in the area surrounding the printing operation but not directly controlled by the printing operation.

Over a period of time of operation of printing equipment of the prior art, as illustrated in FIGS. 1 and 2, the depressions 28 of the etched roll tend to accumulate relatively more viscous, or dried, deposits of ink in the depressions. As the amount of the deposit in a depression increases, the empty volume of the depression which may be used to pick up a fresh quantity of ink decreases.

The more viscous portion 16B of ink in the depression tends to remain in the depression, and not transfer to the printing surface. Portion 16B, with its higher viscosity presents a pseudo-surface to the ink newly picked up from the reservoir, on subsequent revolutions. At point of transfer of ink to the printing surface, a portion of the newly picked up ink remains as a film on the surface of portion 16B, and the amount of ink transferred is thus less than would be transferred by a clean depression, effecting a slight alteration of the printed image from the image as designed. The depression gradually accumulates an increasing deposit 16B of more viscous ink, and sometimes actual dried ink, as compared to liquidous dried ink, with gradually decreasing quantities of ink being transferred to the printing surface. This adversely affects the quality of the image printed. At some point, the reduced quantity of ink picked up and transferred is such that the quality of the printed image is no longer acceptable. At that point the printing operation is shut down for removal of the ink deposits from the roll.

On inspection of roll 12 after shut down, deposits of dried-in ink may be observed in the depressions, and in some cases a thin film of dried ink, known in the art as blushing, may be detected on the smooth portion of roll surface 26 between the depressions 28 on the surface 26 of roll 12. Since dried-in ink is the primary problem, blushing will not be mentioned further in this description, while its presence is contemplated with any occurrence of dried-in ink, and the treatment herein is also effective to control blushing.

In conventional printing operations, it is generally expected that the printing operation will periodically be shut down for removal of ink solids from the etched rolls. Each shut-down and subsequent start up, of course, is costly in that it generates a quantity of unusuable substrate and requires non-productive time of equipment and labor while the ink deposits are removed.

The inventor herein has surprisingly found means for avoiding dried-in ink in the depressions, which dried-in ink is a trait characteristic of conventional printing operations. Further, the invention as disclosed herein may be used to remove dried-in ink deposits. The invention has the capability of preventing the surface of the rotogravure roll, including the depressions, from accumulating excessive dried ink deposits. Indeed, the invention may be used to remove deposits of ink solids from a rotogravure roll while the roll is simultaneously being used in a printing operation.

Figure 8:
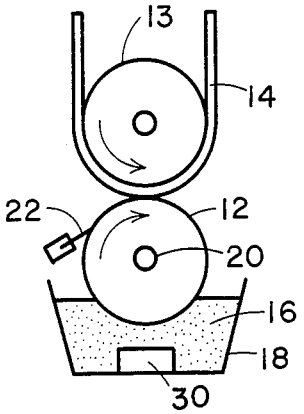
FIGS. 8–11 show various illustrative configurations for arrangement of the ultrasonic emitter relative to the ink, the reservoir and the roll, the end of the ink reservoir having been removed, and enough ink displaced in each Figure to show the end of the roll in the reservoir.
Figure 9:
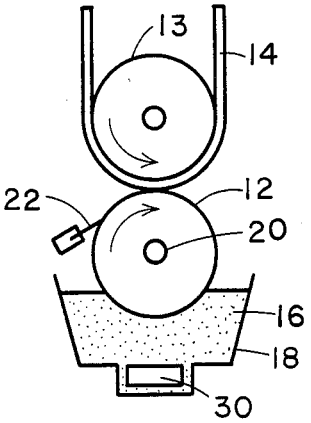
Figure 10:
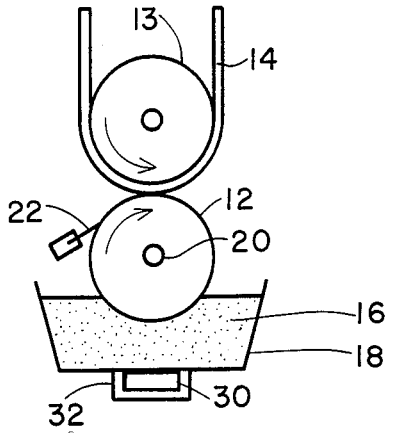
Figure 11:
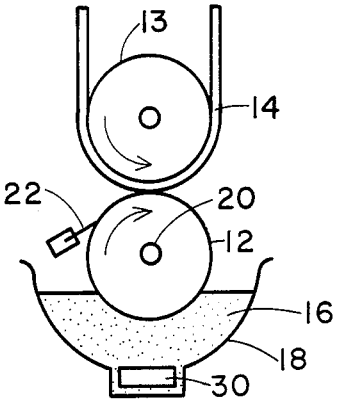

In the invention, ultrasonic energy is applied to the ink 16 in the ink reservoir during the normal course of the printing operation. Typical arrangements of equipments of the invention are shown in FIGS. 8, 9, 10, and 11, which correspond generally to prior art FIG. 1 with the additional provision for the ultrasonic generator and its emitter 30. FIG. 8 shows an ultrasonic emitter 30 placed under roll 12 in a conventional ink reservoir where the emitter is in direct contact with the ink 16. FIG. 9 shows an ultrasonic emitter 30 in a reservoir modified with a recess therein, such that the top of emitter 30 is at more or less the same elevation as the bottom of the reservoir. In FIG. 10, the top of emitter 30 is solidly mounted to the bottom of tray 18 and is enclosed in an additional enclosure 32. FIG. 11 shows emitter 30 in a recessed reservoir as in FIG. 9 and wherein the reservoir is of a more rounded configuration.

While several configurations of the reservoir are shown, these are illustrative only, as the emitter can be used with a wide variety of reservoirs. The principle concern is that the emitter have good transmission of the ultrasonic energy into the ink, or other liquid. This is accomplished in FIGS. 8, 9, and 11 by location of the emitter directly in the ink. Alternately, the emitter may be solidly mounted to the bottom of the reservoir as is shown in FIG. 10. In the FIG. 10 configuration, the solid mounting of the top of the emitter along substantially its entire surface to the bottom of the reservoir ensures that the bottom of the reservoir oscillates together with the top of the emitter, such that the bottom of the reservoir acts somewhat like a single emitter, though with greater mass than emitter 30, as it transmits the ultrasonic energy from the emitter to the ink.

Liquids useful in this invention for removing solids deposits are believed to depend upon a combination of chemical action by the solvent and mechanical action by the ultrasonic energy, though the inventor does not choose to be bound by this theory. The novelty herein resides in the discovery that contaminants may be present in the solvent, and especially at least partially solvated contaminants of the same chemical nature as what may be present on the transfer surface. Thus the nature of the process normally does not provide a cleaning function so much as it provides for prevention of solids build-up and removal of solids from the transfer surface such as a printing roll, by an ongoing scrubbing action.

While the presence of contaminants has been previously considered an obstacle to ultrasonic cleaning, it has been found herein that components capable of forming solid phase material on the transfer surface may be present in any amount so long as the viscosity of the liquid at operating conditions does not exceed 300 centipoise. So 300 centipoise is considered the upper limit for viscosity of liquids useful in the invention. While there are no known technical limitations on the lower limits of the viscosity of the liquid, the viscosity of typically-used uncontaminated solvents is on the order of 1 centipoise, so this is recognized as a functional lower viscosity range. Typical inks used in rotogravure printing have a viscosity of between 5 centipoise and 30 centipoise, whereas flexographic inks typically have viscosities in the range of 25 centipoise to 40 centipoise. Thus, the normal lower range of viscosity of the liquid is 5 centipoise.

The usual ultrasonic cleaning system consists of an electronic generator that supplies energy to an electromechanical transducer which in turn activates a liquid bath. The basic object of the process is to cause violent action in the liquid and thereby create a cleaning action. The violent action created in ultrasonic cleaning systems is called cavitation.

Cleaning system energy is produced by an ultrasonic system consisting of a generator which produces electrical pulses and a transducer, or emitter, which converts the electrical pulses to mechanical vibration at ultrasonic frequency. The electrical pulses are transmitted to the transducer by a connecting cable. The transducer converts the electrical pulses to mechanical vibration through transducer elements which emit the mechanical vibration. The transducer elements are bonded to the surface, usually a metal surface, which is to transmit the mechanical vibration into the liquid. The transducer elements may be mounted to the underside of a tank, for example. In the case of immersible transducer modules, transducer elements are bonded to one selected primary emitting surface of the immersible module. In either case, the transducer emitting face directs the ultrasonic vibrational energy into the liquid.

As the frequency of ultrasonic vibrational energy is reduced to the point where it reaches audible frequencies, its similarity to, and commonality with, common sound is easily perceived. Ultrasonic energy, like any sound wave, is a series of compressions and rarefactions traveling through a medium. Since ultrasonic cavitation only functions in liquid systems, transmissions which are possible through a gaseous medium will not be further discussed.

The compressions and rarefactions tend to alternately compress and pull apart the liquid at the high pressure and low pressure points as the compression and rarefaction waves travel through the liquid medium. When the vibrational energy is of sufficient intensity, the liquid is pulled apart at the rarefaction loci and small bubbles, or cavities, are formed. With the arrival of the immediately following compression wave, the bubbles collapse. This collapse occurs with large, virtually instantaneous, and locallized, pressure changes. Many bubbles are forming and collapsing simultaneously throughout the liquid, creating an effective scrubbing force.

The process of generating and collapsing bubbles in a liquid by means of traveling waves having ultrasonic frequencies is that earlier described herein as cavitation.

It is commonly thought that the success of ultrasonic cleaning is dependent primarily upon the properties of the cleaning liquid. The most prominent properties are vapor pressure, surface tension, viscosity, density, and boiling point as they relate to the temperature of operation of the cleaning system.

Low vapor pressure increases the amount of energy required to cause cavitation to occur as compared to a higher vapor pressure. However, individual cavitation bubbles in liquid having low vapor pressure collapse with greater force, thus producing a more intense cavitation. Higher vapor pressure reduces the power required to create cavitation, however, the intensity of the cavitation is generally less than with a lower vapor pressure liquid. At temperature near the boiling point, bubbles created by the ultrasonic rarefactions may be self sustaining in spite of the compression phase and may fail to collapse. In this case, cleaning is effectively nil.

Surface tension is related to the elasticity of the vapor bubble wall. The greater the surface tension, the greater the force required to stretch the bubble wall in creation and expansion of the bubble. Higher surface tension does also cause the bubble to collapse faster and with more force. Thus high surface tension results in higher intensity cavitation, but at a cost of higher energy consumption. Further, the surface tension must be low enough to wet the surface to be cleaned, so that the liquid is in intimate contact with the surface to be cleaned by the cavitation action.

Viscosity is a measure of liquid shear strength. Ultrasonic energy physically travels through the liquid, and viscosity is a hindrance to that travel. Thus, the lower the viscosity, the better for ultrasonic cavitation.

Density has a minor affect in that more energy is required to vibrate a dense liquid - one having more mass - than a less dense liquid.

The preferred temperature for use of any particular liquid in ultrasonic cleaning is influenced by each of its physical properties, as well as its chemical action. Addition of cleaning chemicals or other adulterants to a liquid is known to affect the physical properties of the liquid and thus its characteristics in cavitation. Conventional wisdom holds that it is important that proper cleaning chemicals be used at the best cleaning temperature range if the ultrasonic cleaning process is to be capable of obtaining proper cleaning results.

Conventional ultrasonic cleaning is directed toward the cleaning of dirtied surfaces. In the typical cleaning operation, dirty parts are immersed in a cleaning liquid which is then subjected to ultrasonic energy to clean the parts. Since the parts are desirous of being completely clean when removed from the cleaning liquid, it is essential that they not pick up a significant amount of contaminants from the liquid after being cleaned and upon removal from the liquid. A retained film of contaminants from the liquid is thus not acceptable in conventional ultrasonic cleaning processes.

As used herein, the ultrasonic energy is effective in its removal action over a distance of up to about 5 inches from the emitting surface that transfers the energy directly to the ink. Therefore this is preferrably the maximum distance between the emitter and the roll 12 for inks which are commonly in the viscosity range of 5–40 centipoise. As viscosity increases, the maximum functional distance necessarily decreases. A clearance of at least ⅛ inch is usually preferred between the emitter and the roll, so this is generally considered the minimum distance between the emitter and the roll, and such shorter distances may be preferred for use with higher viscosity liquids. The length of the emitter is generally the same as the length of the roll, so that the roll, along its entire length, is at least within 5 inches of the emitter. In preferred arrangement, the distance between the roll and the emitter is between 1½ inches and 2 inches.

Figure 12:
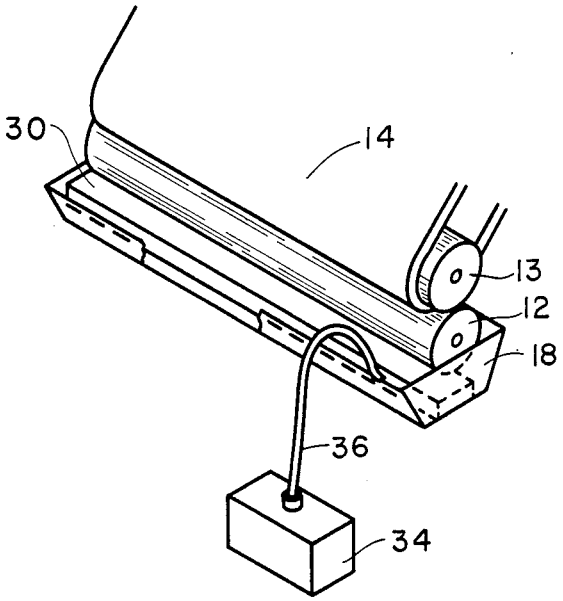
FIG. 12 shows a pictorial view of a printing station of the invention, with a portion of the ink reservoir cut away to show the ultrasonic emitter.

The ultrasonic generator has a frequency of 5 kilohertz to 100 kilohertz, with a preferred frequency of 20 kilohertz to 40 kilohertz. A particularly preferred ultrasonic generator has an output frequency of 40 kilohertz and a power input of 550 watts, this generator being preferred for use in routine operation with an etched rotogravure roll having a printing surface, as at 26 in FIG. 3, which is about 36 inches in length. Typical ink viscosity is 20 centipoise. FIG. 12 shows a pictorial view of an ultrasonic transducer as used in this invention. The transducer is comprised of a controller 34, and emitter 30, and a cable 36 connecting the controller to the emitter. FIG. 12 illustrates the preferred characteristic in that the length of the emitter 30 is generally the same as the length of the roll 12 to be treated by the ultrasonic energy. Emitter 30 may, if desired, comprise a plurality of emitter sections, for example laid end-to-end, where the combined lengths of the sections extends for generally the desired length of roll 12.

It has been surprising to discover that ultrasonic energy is useful in a contaminated liquid, as ultrasonic cleaning has, in the past, always used a clean liquid, or solvent, as the cleaning medium, for the cleaning function. The inventor has discovered that contaminants do not prevent the removal function.

Inks contain several components as normal fractions of the ink composition, in addition to the solvent, which solvent may ordinarily be considered the cleaning solution when in its uncontaminated form. The other components can be considered contaminants of the solvent for purposes of ultrasonic action. They may include a colorant, and usually a resin. They may also include surfactants, penetrants, stabilizers, reactants and the like. It has been surprisingly found that the presence of these contaminants in the amounts normally found in ink formulations does not prevent the desired action of the combination of solvent and ultrasonic energy. Typical formulations are:

| | |
|---|---|
| Typical Ink #1 | |
| Ethyl alcohol | 5.5% |
| N—propyl alcohol | 52.0% |
| Heptane | 9.9% |
| Methanol | 12.6% |
| Toluene | 0.4% |
| N—propyl acetate | 0.7% |
| Resin-modified polyamide | 12.7% |
| Pigment | 6.2% |
| | 100.0% |
| Typical Ink #2 | |
| Ethyl alcohol | 22.4% |
| Isopropyl acetate | 11.0% |
| Isopropyl alcohol | 3.3% |
| N—propyl acetate | 25.5% |
| Ethyl acetate | 15.3% |
| Resin-nitrocellulose | 15.2% |
| Pigment | 7.3% |
| | 100.0% |

The fundamental capability of ultrasonic vibration is anticipated to be a function of the combination of the ability to transmit the ultrasonic energy and generate cavitation at the roll surface and the mobility, in the liquid, of material which is removed from the roll surface. Sufficient energy must reach the roll surface to remove material from it. It is believed that the removed material should be sufficiently mobile in the liquid to move at least a minimal distance from the roll surface so that it not be continuously entrained in the film of liquid traveling with the surface of the rotating roll. Liquids having a viscosity of less than 300 centipoise in their continuous phase apparently permit this mobility.

While the inventio has been described in terms of treating of printing equipment, as for printing inks, the inventive method and apparatus may be used for treating other liquids wherein a solvent and a contaminant are present. Such liquids include adhesives, paints, varnishes, and the like, all of which contain a resin component capable of forming a solid deposit on a substrate. It is not necessary that the treated surface be free from all the liquid and its contaminants at any one time, but rather the treatment prevents an excessive build-up on the surface, or in the roll depressions, of a higher viscosity material, which excessive build-up would significantly affect the quality of the transfer process, such as by poorer quality of printing of indicia.

The depressions on the roll may take on a variety of configurations. Spot depressions as in FIG. 4 are common on rotogravure printing rolls. Rolls for applying coatings may contain a pattern of grooves, such as parallel or crossing lines. The patterns may be different on various sections of the roll. The roll may even have a smooth and uniform surface. So long as the roll is within the effective range of the ultrasonic energy emitted by the emitter, and so long as the energy is transmitted through a suitable contaminated liquid medium, the desired scrubbing of the surface will be effected.

The printing surface involved in the method of the invention is not critical to the operation of the invention, as all known printing surfaces have the characteristic of permitting a portion of the transferring liquid to remain on the transferring surface of the roll, thus giving rise to the fundamental problem addressed herein. It is anticipated that the invention may be used in printing, such as rotogravure and flexographic printing, and on such exemplary printing surfaces as paper, plastic, cloth, or metal. The invention may be used for applying coatings. Indeed it is anticipated that the invention may be used for applying images or coating to rigid and curved surfaces such as metal cans.

The methods and systems in the invention are distinct from the conventional meaning of "cleaning" of substrates. Conventionally, "cleaning" includes removal of substantially all contaminants from the substrates. For example, a clean rotogravure roll would not contain any significant amount of ink on its surface, or in its depressions. As used in the invention, the function of the ultrasonic energy is not so much a clearning operation, as the roll is continually picking up a film of ink from the reservoir. Rather, the ultrasonic energy is used as a means for controlling ink solids on the roll. In adhesive operations, the ultrasonic energy is used as a means for controlling adhesive solids. Other liquids containing solidsforming components would function similarly.

The portion of the invention involved with removal of solids from a substrate has been described generally in terms that may tend to imply that the contaminant in the liquid need be chemically similar to the solid phase material or a precursor thereof. While that relationship does not represent typical uses of the invention, it is not necessary to the invention. Indeed, the contaminant may be dissimilar from the solids.

Thus it is seen that the invention provides a method of applying to a printing surface, by means of a transfer surface, a liquid containing components capable of drying on the transfer surface; and accomplishing the transfer without attendant drying of the liquid on the transfer surface.

The invention also provides a method of printing, using a printing roll, and especially a rotogravure roll, and accomplishing the printing without attendant drying of the ink on the roll.

The invention further provides a novel method of removing dried material from a transfer surface. Specifically, the invention provides a method of removing from a printing roll ink dried on its surface or in its surface depressions.

The invention further provides a combination of apparatus for applying to a printing surface, by means of a transfer surface, a liquid containing components capable of drying on the transfer surface, and accomplishing the transfer without attendant drying of the liquid on the transfer surface.

Having thus described the invention, what is claimed is:

1. A process for removing a particular solid phase material from a selected portion of a substrate, said process comprising the steps of:

(a) preparing, as a liquid medium useful for depositing a layer of material on a substrate, a liquid composition comprising (i) a solvent for said particular solid phase material and (ii) a resinous portion capable of forming a solid phase material;

(b) bringing said particular solid phase material and said liquid composition together in a liquid reservoir; and (c) applying, to said liquid, an effective amount of ultrasonic energy while maintaining a relatively constant amount of said liquid composition in said reservoir, whereby said solid phase material is removed from said selected portion of said substrate, as a solid phase material.

2. A process as in claim 1 and including the step of intermittently removing said particular solid phase material on said selected portion of said substrate from said liquid composition for a period of time insufficient to permit a net accumulation of said resinous portion on said substrate as a solid phase material.

3. A process as in claim 2 wherein said substrate is a generally cylindrical roll and said roll is partially immersed in a reservoir of said liquid.

4. A process as in claim 2 wherein said resinous portion is capable of forming a film.

5. A process as in claim 3 wherein said resinous portion is capable of forming a film.

6. A process as in claim 4 wherein said liquid composition further includes a colorant.

7. A process as in claim 5 wherein said liquid composition further includes a colorant.

8. A process as in claim 4 wherein the viscosity of said liquid composition is between 5 centipoise and 40 centipoise.

9. A process as in claim 5 wherein the viscosity of said liquid composition is between 5 centipoise and 40 centipoise.

10. A process for removing dried-in ink solids from depressions of an etched printing roll, comprising the steps of:

(a) putting a portion of said roll in an ink similar or equivalent to the ink which produced said dried-in ink solids, said ink containing a solvent for said dried-in ink solids and a resinous portion, and having a viscosity of less than 300 centipoise, said ink being contained in a reservoir;

(b) rotating said roll in said ink; and (c) concurrently applying to said ink an effective amount of ultrasonic energy, while maintaining a relatively constant amount of said ink in said reservoir, whereby said dried-in ink solids are removed from said roll at portions of said roll which are wetted by said ink.

11. A process as in claim 10 and wherein the entire length of the circumferential surface of said roll is wetted by said ink and the dried-in ink solids are removed from said depressions along the entire length of said roll.

12. A process as in claim 11 wherein the viscosity of said ink is between 5 centipoise and 40 centipoise and wherein said ultrasonic energy has a frequency of between 20 kilohertz and 40 kilohertz.

13. A method of applying to a printing surface a liquid containing components capable of forming a solid phase at the conditions of operation, said method comprising:

(a) placing said liquid in a liquid reservoir;

(b) positioning, in said liquid, a portion of a transferring means for transferring liquid from said reservoir to said printing surface;

(c) picking up a quantity of said liquid from said reservoir, on said transferring means;

(d) depositing a first portion of said quantity of said liquid, from said transferring means, onto said printing surface, whereby a second portion of said quantity of said liquid remains on said transferring means;

(e) returning said second portion, on said transferring means, to said liquid in said reservoir; and (f) concurrently with step (e), applying to said liquid, in said liquid reservoir, an effective amount of ultrasonic energy while maintaining a relatively constant amount of said ink in said reservoir, whereby said second portion of said quantity of liquid is substantially prevented from forming a solid phase on said transferring means.

14. A method as in claim 13 wherein said liquid is a printing ink, said transferring means is a cylindrical printing roll, and the entire length of the circumferential surface of said roll is wetted by said ink.

15. A method as in claim 13 wherein the viscosity of said liquid is between 5 centipoise and 300 centipoise and wherein said ultrasonic energy has a frequency of between 20 kilohertz and 40 kilohertz.

16. A method as in claim 14 wherein the viscosity of said ink is between 5 centipoise and 300 centipoise and wherein said ultrasonic energy has a frequency of between 20 kilohertz and 40 kilohertz.

17. A method as in claim 14 and wherein said transferring means has depressions thereon, said depressions being capable of holding a small quantity of said liquid.

18. A method as in claim 17 wherein said ink has a viscosity of between 5 centipoise and 30 centipoise and is transferred from said printing roll directly onto a printed surface.

19. A method as in claim 17 wherein said ink has a viscosity of between 25 centipoise and 40 centipoise and is transferred first to an offset roll and from said offset roll onto a printed surface.

20. A method of printing wherein a roll is positioned and rotated in a reservoir of ink, the method comprising the steps of withdrawing ink from said ink reservoir on said roll and transferring said ink from said roll to a receiving surface, and concurrently applying to said ink, in said reservoir, an effective amount of ultrasonic energy to substantially prevent said ink from drying on said roll, while simultaneously maintaining a relatively constant amount of ink in said reservoir.

21. A method as in claim 20 wherein the viscosity of said ink is less than 300 centipoise and wherein said ultrasonic energy has a frequency of between 20 kilohertz and 40 kilohertz.

22. A method as in claim 21 and wherein said ink has a viscosity of between 5 centipoise and 30 centipoise and said ink is transferred directly from said roll onto a printed surface.

23. A method as in claim 21 and wherein said ink has a viscosity of between 25 centipoises and 40 centipoise and wherein said ink is transferred first to an offset roll and from said offset roll onto a printed surface.

24. A method as in claim 20, said roll having surface depressions thereon, and said ink being withdrawn from said reservoir in said depressions.

25. A method of avoiding solids build-up on a transferring surface of a printing roll, during a printing operation, said method comprising the steps of:

(a) placing an ink having a viscosity of less than 300 centipoise in an ink reservoir;

(b) placing a printing roll in said ink in a printing assemblage, such that a first portion of the roll, along the length thereof is in said ink and a second portion is out of said ink; and (c) rotating said roll in said ink to thereby pick up ink from said reservoir and apply said ink to a printing substrate while maintaining a relatively constant amount of ink in said reservoir and applying to said ink, in said reservoir, an amount of ultrasonic energy effective to prevent solids build-up on said transferring surface of said printing roll.

* * * * *